US008998618B2

(12) United States Patent
Hashiguchi

(10) Patent No.: US 8,998,618 B2
(45) Date of Patent: Apr. 7, 2015

(54) CONNECTOR

(75) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 13/173,426

(22) Filed: Jun. 30, 2011

(65) Prior Publication Data

US 2012/0003843 A1 Jan. 5, 2012

(30) Foreign Application Priority Data

Jul. 2, 2010 (JP) ..... 2010-152334

(51) Int. Cl.

| | |
|---|---|
| ***H01R 39/00*** | (2006.01) |
| ***H01R 13/631*** | (2006.01) |
| ***H01R 13/11*** | (2006.01) |
| *H01R 31/06* | (2006.01) |

(52) U.S. Cl.

CPC ..... *H01R 13/6315* (2013.01); *H01R 13/113* (2013.01); *H01R 31/06* (2013.01)

(58) Field of Classification Search

CPC ... H01R 13/193; H01R 13/112; H01R 13/113
USPC ..... 439/439, 638, 654, 650, 12, 495, 429, 439/459, 786, 787
See application file for complete search history.

(56) References Cited

U.S. PATENT DOCUMENTS

| | | | | |
|---|---|---|---|---|
| 4,220,382 | A * | 9/1980 | Ritchie et al. | 439/61 |
| 4,423,917 | A * | 1/1984 | Scheingold et al. | 439/249 |
| 4,659,155 | A * | 4/1987 | Walkup et al. | 439/108 |
| 4,684,191 | A * | 8/1987 | Feher et al. | 439/246 |
| 4,747,790 | A * | 5/1988 | Masuda et al. | 439/631 |
| 4,878,862 | A * | 11/1989 | Wise | 439/787 |
| 5,086,372 | A * | 2/1992 | Bennett et al. | 439/64 |
| 5,501,610 | A * | 3/1996 | Ikemoto | 439/67 |
| 5,738,545 | A * | 4/1998 | Igarashi et al. | 439/492 |
| 5,865,654 | A * | 2/1999 | Shimirak et al. | 439/654 |
| 5,879,177 | A * | 3/1999 | Honma | 439/654 |
| 6,250,966 | B1 * | 6/2001 | Hashimoto et al. | 439/631 |
| 6,520,797 | B2 * | 2/2003 | Okamura et al. | 439/495 |
| 6,827,608 | B2 * | 12/2004 | Hall et al. | 439/851 |
| 7,044,773 | B2 * | 5/2006 | Suzuki et al. | 439/495 |
| 7,204,719 | B2 * | 4/2007 | Kikuchi | 439/638 |
| 7,549,882 | B2 | 6/2009 | Kimura | |
| 8,038,467 | B2 * | 10/2011 | Shen et al. | 439/495 |
| 2007/0202736 | A1 * | 8/2007 | Takashita | 439/495 |

FOREIGN PATENT DOCUMENTS

JP 2008-198441 A 8/2008

* cited by examiner

*Primary Examiner* — Briggitte R Hammond
(74) *Attorney, Agent, or Firm* — Holtz, Holtz, Goodman & Chick PC

(57) ABSTRACT

A connector which is capable of accommodating displacement between objects to be connected, and prevents an operation force required in connecting the connector and the objects and the amount of deformation of the contacts from becoming too large. A plurality of contacts are each provided with contact portions which sandwich a plate-shaped contact portion of a contact (first object to be connected) in a manner capable of relatively pivoting in a direction of thickness thereof, and contact portions which sandwich a plate-shaped contact portion of a contact (second object to be connected) in a manner capable of relatively pivoting in a direction of thickness thereof. The contacts are accommodated in a contact-accommodating hole of a housing in a manner capable of pivoting in the direction of the thickness of each of the contact portions of the first and second objects to be connected.

19 Claims, 14 Drawing Sheets

CONNECTOR

BACKGROUND OF THE INVENTION

1. Field of the Invention

This invention relates to a connector which is interposed between two objects to be connected and electrically connects the two objects to be connected to each other.

2. Description of the Related Art

Conventionally, there has been known a connector which comprises a plurality of contacts, and first and second housings which hold the plurality of contacts (see Japanese Laid-Open Patent Publication (Kokai) No. 2008-198441, (Paragraphs 0032, 0035, 0036, 0050, and 0051, FIGS. 9 to 13, and so forth).

The plurality of contacts are arranged in upper and lower two levels, and the contacts in the upper level and those in the lower level are line-symmetrical with each other.

The plurality of contacts each include first and second contact portions, first and second spring portions, first and second holding portions, and a floating portion.

When electrically connecting a card board and a motherboard using this connector, even though the card board is positioned relatively upward with respect to the motherboard, or is inclined with respect to the motherboard, the contacts are deformed, so that displacement between the two boards in a vertical direction and the inclination of the card board with respect to the motherboard are accommodated, whereby a favorable contact state between the first and second contact portions and the two boards is ensured.

However, in the above-mentioned connector, a contact force of the first contact portion which is brought into contact with the card board sometimes becomes much larger than that of the second contact portion which is brought into contact with the motherboard, or the floating portion is sometimes largely deformed. This may increase an operating force required in fitting the connector to the card board, and may cause plastic deformation of the first and second contact portions and the floating portion, or may impair the contact stability of the contact portions.

SUMMARY OF THE INVENTION

The present invention has been made in view of these circumstances, and an object thereof is to provide a connector which is capable of accommodating displacement between objects to be connected, and prevents an operation force required in connecting the connector and the objects and the amount of deformation of the contacts from becoming too large.

To attain the above object, the present invention provides a connector that electrically connects a first object to be connected and a second object to be connected to each other, comprising a plurality of plate-shaped contacts each including a first contact portion that sandwiches a plate-shaped contact portion of the first object to be connected in a manner capable of relatively pivoting in a direction of thickness of the plate-shaped contact portion, and a second contact portion that sandwiches a plate-shaped contact portion of the second object to be connected in a manner capable of relatively pivoting in a direction of thickness of the plate-shaped contact portion, and a holding member that holds the plurality of plate-shaped contacts in a state arranged in a direction of thickness thereof.

With the arrangement of the connector according to the present invention, if the plate-shaped contact portions of the first and second objects to be connected are displaced in the direction of the thickness thereof, when connecting the plate-shaped contact portions with each other using the connector, the connector is pivoted according to the displacement amount to thereby accommodate the displacement, and hence the operation force required in connecting the first and second objects to be connected and the connector and the amount of deformation of the plate-shaped contacts are hardly changed, compared with when plate-shaped contact portions of the first and second objects to be connected are not displaced in the direction of the thickness thereof.

Preferably, the plurality of plate-shaped contacts are each supported by the holding member in a manner capable of pivoting in the direction of thickness of each of the plate-shaped contact portions of the first and second objects to be connected.

More preferably, the plurality of plate-shaped contacts are in contact with each other in the direction of thickness thereof.

Further preferably, the plurality of plate-shaped contacts each have an identical shape.

Preferably, the holding member is a housing that has a contact-accommodating hole for accommodating the plurality of plate-shaped contacts.

More preferably, the plurality of plate-shaped contacts are each accommodated in the contact-accommodating hole in a state in which the plurality of plate-shaped contacts are slidably held.

Further preferably, the plate-shaped contacts each include a linking portion and a lance, and the housing includes stoppers each of which is brought into abutment with the linking portion, and engaging portions each of which latches the lance.

More preferably, the holding member has screw insertion holes for movably mounting the holding member to a casing to which the first object to be connected is fixed.

Preferably, the plate-shaped contacts each have an intermediate portion formed with an insertion hole, and the holding member includes a plate-shaped main body which is inserted through the insertion holes of the plurality of plate-shaped contacts arranged in the direction of the thickness thereof, first stoppers which are provided on the main body, and are brought into contact with one of the plate-shaped contacts in the thickness direction, which is located at one end of the plurality of plate-shaped contacts arranged in the direction of the thickness thereof, and second stoppers which are provided on the main body, and are brought into contact with one of the plate-shaped contacts in the thickness direction, which is located at the other end of the plurality of plate-shaped contacts arranged in the direction of the thickness thereof.

More preferably, the holding member has screw insertion holes for movably mounting the holding member to a casing to which the first object to be connected is fixed.

Preferably, the plate-shaped contacts each have an intermediate portion formed with insertion holes, and the holding member includes a pair of fixing portions that sandwich the plurality of plate-shaped contacts in the direction of thickness thereof, which are arranged in the direction of the thickness thereof, and screws which are inserted through the insertion holes of the plurality of plate-shaped contacts arranged in the direction of the thickness thereof, and connect the pair of fixing portions.

More preferably, the holding member has screw insertion holes for movably mounting the holding member to a casing to which the first object to be connected is fixed.

Preferably, the plate-shaped contacts each have an intermediate portion formed with insertion holes, and the holding member is formed by bolts which are inserted through the insertion holes of the plurality of plate-shaped contacts arranged in the direction of the thickness thereof, and nuts which are screwed onto the bolts.

According to this invention, it is possible to accommodate displacement between the objects to be connected and the like, and prevent the operation force required in connecting the connector and the objects and the amount of deformation of the contacts from becoming too large.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

First, a description will be given of a connector according to a first embodiment of the present invention with reference to FIGS. 1 to 5.

Figure 1:
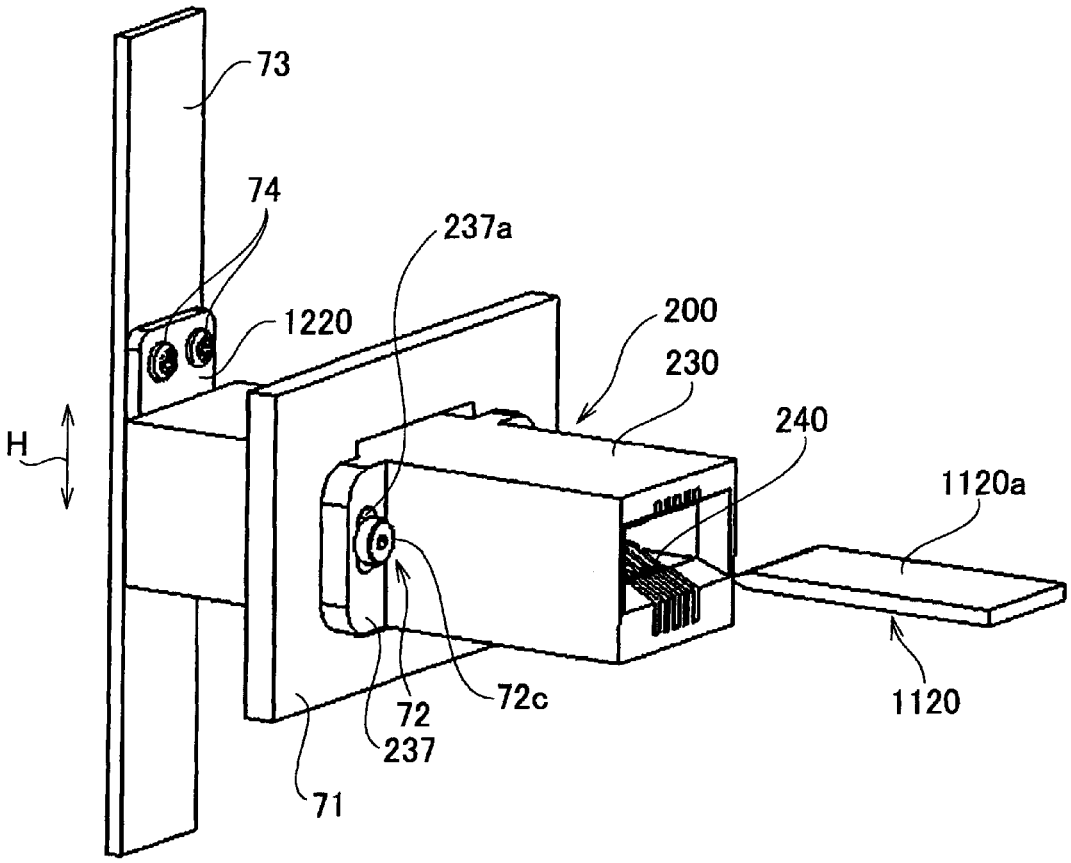
FIG. 1 is a perspective view of a connector according to a first embodiment of the present invention.

As shown in FIG. 1, a connector 200 comprises a housing (holding member) 230 and a plurality of contacts (plate-shaped contacts) 240 which are held by the housing 230. The connector 200 is used for electrically connecting a contact (first object to be connected) 1220 which is mechanically and electrically connected to a bus bar 73 fixed to a casing of an electronic device (e.g. an electric power converter), not shown, within the casing, and a contact (second object to be connected) 1120 which is disposed in an electronic device (e.g. a battery), not shown, to each other, and passing large electric current between those electronic devices.

Figure 3:
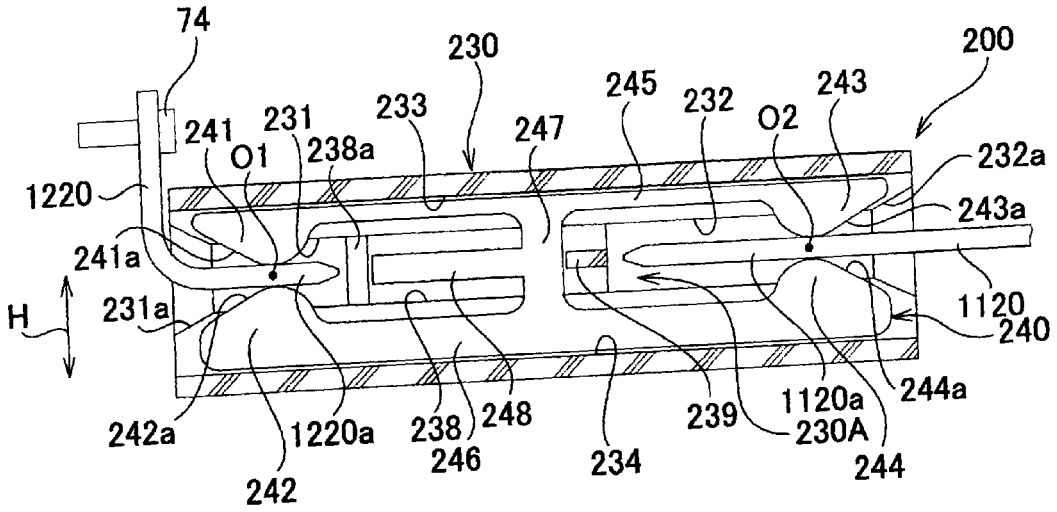
FIG. 3 is a cross-sectional view taken along line III-III of FIG. 2.
Figure 4:
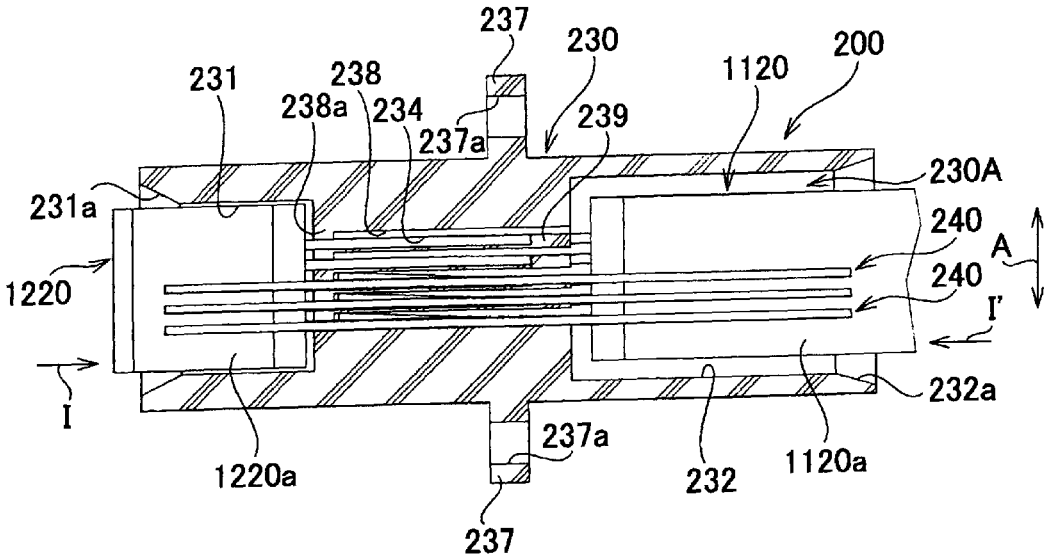
FIG. 4 is a cross-sectional view taken along line IV-IV of FIG. 2.

The contacts 1220 and 1120 have respective contact portions (plate-shaped contact portions) 1220*a* and 1120*a* each having a plate-like shape (see FIGS. 3 and 4). The direction of thickness of the contact portion 1220*a* of the contact 1220 and the direction of thickness of the contact portion 1120*a* of the contact 1120 are substantially parallel to each other. When the connector 200 is in the state illustrated in FIG. 3, the direction of thickness of the contact portion 1220*a* and the direction of thickness of the contact portion 1120*a* are parallel to the height direction H of the connector 200 (see FIG. 3).

The contact 1220 is substantially L-shaped, and has a rear end fixed to the bus bar 73 with screws 74 (see FIGS. 3 and 1).

Figure 2:
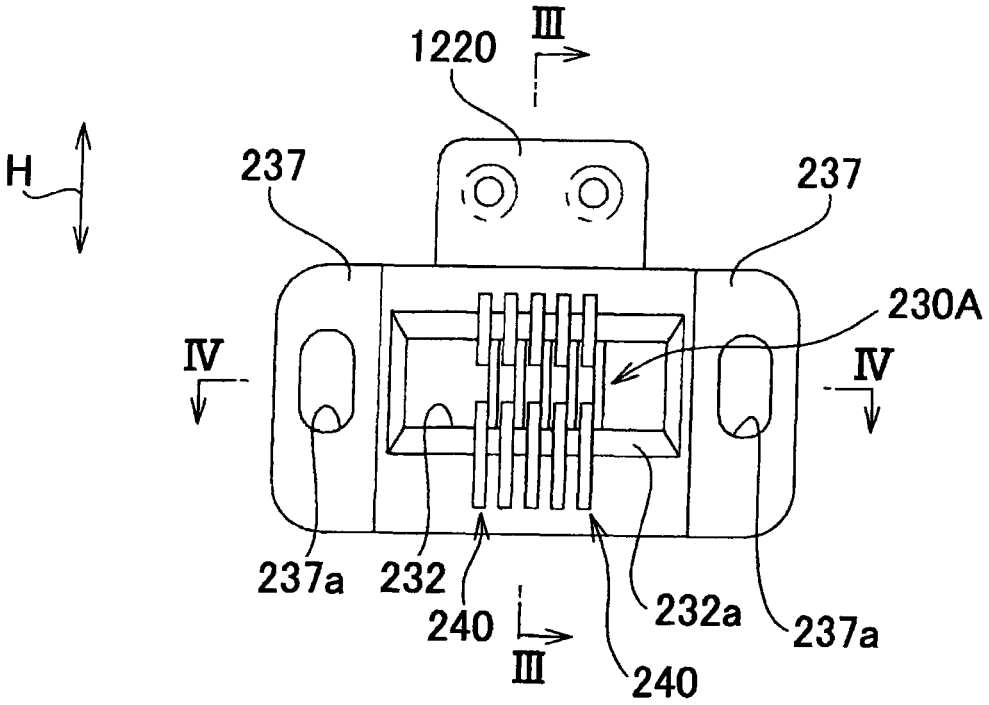
FIG. 2 is a front view of the connector shown in FIG. 1.

As shown in FIGS. 2, 3, and 4, the housing 230 is substantially hollow prism-shaped. The housing 230 is formed of a synthetic resin. The housing 230 has a contact-accommodating hole 230A which extends in a longitudinal direction thereof. The contact-accommodating hole 230A of the housing 230 accommodates the plurality of contacts 240.

A rear portion (left portion of the contact-accommodating hole 230A as viewed in FIGS. 3 and 4) of the contact-accommodating hole 230A forms a first receiving hole 231, a front portion (right portion of the contact-accommodating hole 230A as viewed in FIGS. 3 and 4) of the contact-accommodating hole 230A forms a second receiving hole 232, and an intermediate portion of the contact-accommodating hole 230A forms a plurality of third receiving holes 238.

The contact portion 1220*a* of the contact 1220 sandwiched by contact portions 241 and 242 of the contacts 240, referred to hereinafter, is inserted into the first receiving hole 231. The first receiving hole 231 of the housing 230 has the rim of an opening thereof formed with a guiding surface 231*a* for guiding the contact portion 1220*a* of the contact 1220 into the first receiving hole 231.

The contact portion 1120*a* of the contact 1120 sandwiched by contact portions 243 and 244 of the contacts 240, referred to hereinafter, is inserted into the second receiving hole 232. The second receiving hole 232 of the housing 230 has the rim of an opening thereof formed with a guiding surface 232*a* for guiding the contact portion 1120*a* of the contact 1120 into the second receiving hole 232. The second receiving hole 232 has a width in a contact-arranging direction A (see FIG. 4) which is larger than a width of the contact 1120.

The contact-accommodating hole 230A has a plurality of first recesses 233 and a plurality of second recesses 234 (see FIG. 3). The first recesses 233 are formed in an upper portion of the housing 230 along the contact-arranging direction A of the contacts 240 at equally-spaced intervals, and extend from a front end (right end of the housing 230 as viewed in FIGS. 3 and 4) to a rear end (left end of the housing 230 as viewed in FIGS. 3 and 4) of the housing 230. The first recesses 233 communicate with the first, second, and third receiving holes 231, 232, and 238. The second recesses 234 are formed in a lower portion of the housing 230 along the contact-arranging direction A of the contacts 240 at equally-spaced intervals, and extend from the front end to the rear end of the housing 230. The second recesses 234 are opposed to the first recesses 233 in a direction H of height of the connector 200, and communicate with the first, second, and third receiving holes 231, 232, and 238.

The plurality of third receiving holes 238 are formed along the contact-arranging direction A at equally-spaced intervals. One end of each third receiving hole 238 communicates with the first receiving hole 231, and the other end of each third receiving hole 238 communicates with the second receiving hole 232. A stopper 239 extends from an end portion, toward the second receiving hole 232, of one of inner periphery surfaces, opposed to each other in the contact-arranging direction A, of each third receiving hole 238, in a manner protruding in the contact-arranging direction A. An engaging portion 238*a* is formed on an end portion, toward the first receiving hole 231, of the other of the inner periphery surfaces, opposed to each other in the contact-arranging direction A, of the third receiving hole 238.

The third receiving holes 238 each accommodate a linking portion 247 and a lance 248 of each contact 240, referred to hereinafter.

The housing 230 has flanges 237 formed on respective opposite sides thereof. Each flange 237 is formed with an elongated hole (screw insertion hole) 237*a*. The elongated hole 237*a* is elongated in the direction H of the height of the connector 200.

The contact portions 241 and 242 of the plurality of contacts 240 are brought into contact with one contact 1220, and the contact portions 243 and 244 of the plurality of contacts 240 are brought into contact with one contact 1120. It is for the purpose of making it possible to pass a large electric current from the contact 1120 to the contact 1220 that the two contacts 1220 and 1120 are thus electrically connected with each other using the plurality of contacts 240. As shown in FIG. 3, the plurality of contacts 240 each include four contact portions 241, 242, 243, and 244, two holding portions 245 and 246, one linking portion 247, and one lance 248. The plurality of contacts 240 each have the same shape. The plurality of contacts 240 are each formed by blanking and bending one metal plate.

The contact portion 241 (first contact portion) and the contact portion 242 (first contact portion) are opposed to each other in the direction H of the height of the connector 200. Part of the contact portion 241 is accommodated in an associated one of the first recesses 233, and the rest of the contact portion 241 protrudes into the first receiving hole 231. Part of the contact portion 242 is accommodated in an associated one of the second recesses 234, and the rest of the contact portion 242 protrudes into the first receiving hole 231. The contact portions 241 and 242 sandwich the contact portion 1220*a* of the contact 1220. Contact points of the contact portions 241 and 242 are each formed into a substantially arcuate shape, and are brought into contact with the contact portion 1220*a*.

The contact portion 243 (second contact portion) and the contact portion 244 (second contact portion) are opposed to each other in the direction H of the height of the connector 200. Part of the contact portion 243 is accommodated in an associated one of the first recesses 233, and the rest of the contact portion 243 protrudes into the second receiving hole 232. Part of the contact portion 244 is accommodated in an associated one of the second recesses 234, and the rest of the contact portion 244 protrudes into the second receiving hole 232. The contact portions 243 and 244 sandwich a portion of the contact portion 1120*a* of the contact 1120 rearward of a front end thereof. Contact points of the contact portions 243 and 244 are each formed into a substantially arcuate shape, and are brought into contact with the contact portion 1120*a*.

One end of the holding portion 245 is continuous with the contact portion 241, and the other end is continuous with the contact portion 243. The holding portion 245 is slidably accommodated in an associated one of the first recesses 233. One end of the holding portion 246 is continuous with the contact portion 242, and the other end is continuous with the contact portion 244. The holding portion 246 is slidably accommodated in an associated one of the second recesses 234.

The linking portion 247 links the holding portion 245 and the holding portion 246.

The lance 248 is continuous with the linking portion 247, and extends toward the rear of the housing 230. The lance 248 is bent in a direction of thickness of the contact 240 such that a front end of the lance 248 is latched at the engaging portion 238*a*. The direction of thickness of the contact 240 is parallel to the contact-arranging direction A in which the contacts 240 are arranged (see FIG. 4).

To assemble the contacts 240 to the housing 230, each contact 240 is inserted into the contact-accommodating hole 230A of the housing 230 from the rear of the housing 230. At this time, the contact portions 241 and 243, and the holding portion 245 are inserted in an associated one of the first recesses 233, and the contact portions 242 and 244, and the holding portion 246 are inserted in an associated one of the second recesses 234. When each contact 240 is inserted in the contact-accommodating hole 230A of the housing 230 by a predetermined amount, the linking portion 247 is brought into abutment with the stopper 239 within an associated one of the third receiving holes 238 of the contact-accommodating hole 230A, and the front end of the lance 248 is latched at the engaging portion 238*a*. As a result, each of the plurality of contacts 240 accommodated in the contact-accommodating hole 230A is separately held in a manner slidable in a vertical direction and a horizontal direction in FIG. 3.

The connector 200 is mounted to a panel (part of the casing which accommodates the bus bar 73) 71 with screws 72 inserted through the elongated holes 237*a* of the flanges 237 of the housing 230. It should be noted that FIG. 1 only partially illustrates the panel 71 and the bus bar 73 for convenience' sake. Each screw 72 includes a screw thread portion (not shown), a body portion (not shown), and a head portion 72*c*. The screw thread portion is screwed into a female screw portion (not shown) of the panel 71. The body portion is continuous with the screw thread portion. The body portion has an outer diameter larger than that of the screw thread portion. The body portion has a length larger than the thickness of the flange 237, and the outer diameter thereof is slightly smaller than an inner diameter of the elongated hole 237*a* in a lateral direction thereof. The head portion 72*c* is continuous with the body portion, and has an outer diameter larger than the inner diameter of the elongated hole 237*a* in the lateral direction. Therefore, when the screw thread portion of the screw 72 is completely screwed into the female screw portion of the panel 71, although the body portion is brought into abutment with the panel 71, a space is generated between a lower surface of the head portion 72*c* and an upper surface of the flange 237. As a result, the body portion of the screw 72 can be relatively moved within the elongated hole 237*a* in the height direction H.

Figure 5:
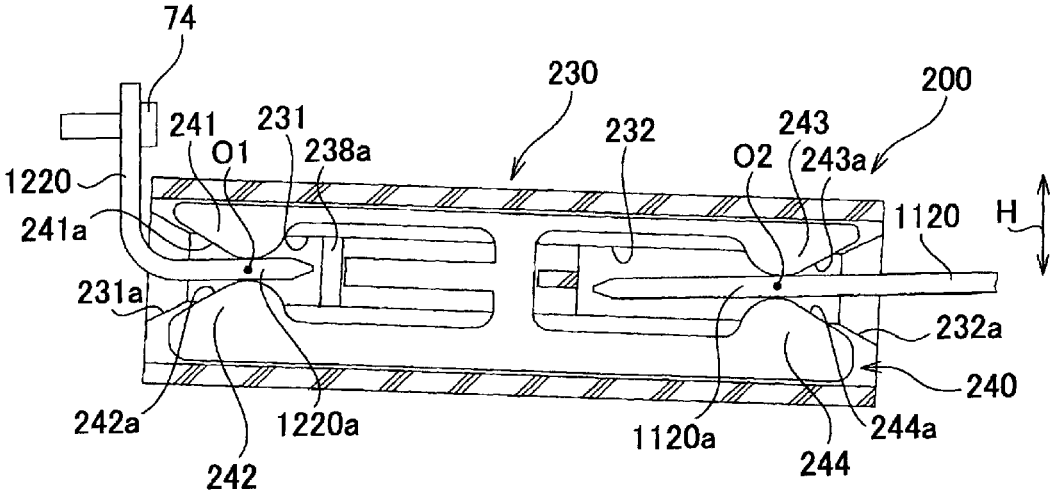
FIG. 5 is a cross-sectional view of the connector shown in FIG. 1 in a state of use.

When the connector 200 is mounted to the panel 71, the contact portion 1220*a* of the contact 1220 fixed to the bus bar 73 with the screws 74 is inserted into the first receiving hole 231 of the connector 200, and is sandwiched between the contact portions 241 and 242. If the position of the contact portion 1220*a* of the contact 1220 is displaced with respect to the connector 200 in the height direction H, the front end of the contact portion 1220*a* is brought into abutment with the guiding surface 231*a* of the housing 230 (when a displacement amount is small, the contact portion 1220*a* is brought into abutment with a guiding surface 241*a* or 242*a* of each contact 240), and then the contact portion 1220*a* of the contact 1220 is inserted between the contact portions 241 and 242 of the contacts 240, whereby as shown in FIG. 5, the connector 200 is inclined. That is, the contact portions 241 and 242 sandwich the contact portion 1220*a* of the contact 1220, and the contacts 240 are each pivoted about a substantially intermediate point 01 between the contact portions 241 and 242 in the direction of the thickness of the contact portion 1220*a* of the contact 1220, so that the distance between the contact portions 241 and 242 is hardly changed and the contact portions 241 and 242 remain in contact with the contact portion 1220*a*.

Further, if the contact portion 1220*a* of the contact 1220 is inclined (in so-called torsion) about an axis parallel to a direction I (see FIG. 4) of inserting the contact portion 1220*a*, when the contact portion 1220*a* of the contact 1220 is inserted into the first receiving hole 231 of the connector 200, the plurality of contacts 240 are each independently pivoted in the direction of the thickness of the contact portion 1220*a* to thereby accommodate the torsion of the contact portion 1220*a* of the contact 1220.

If the position of the contact portion 1120*a* of the contact 1120 is displaced with respect to the connector 200 in the height direction H, when the contact 1120 is inserted into the second receiving hole 232 of the connector 200 mounted to the panel 71, the front end of the contact portion 1120*a* is brought into abutment with the guiding surface 232*a* of the housing 230 (when a displacement amount is small, the contact portion 1120*a* is brought into abutment with a guiding surface 243*a* or 244*a* of each contact 240) and then contact portion 1120*a* of the contact 1120 is inserted between the contact portions 243 and 244, whereby as shown in FIG. 5, the connector 200 is inclined. That is, the contact portions 243 and 244 sandwich the contact portion 1120*a* of the contact 1120, whereby each contact 240 is pivoted about a substantially intermediate point 02 between the contact portions 243 and 244 in the direction of the thickness of the contact portion 1120*a* of the contact 1120, so that the distance between the contact portions 243 and 244 is hardly changed. At this time, the contact portions 243 and 244 are always in contact with the contact portion 1120*a*.

Further, if the contact portion 1120*a* of the contact 1120 is inclined (in so-called torsion) about an axis parallel to a direction I' (see FIG. 4) of inserting the contact portion 1120*a*, when the contact portion 1120*a* of the contact 1120 is inserted into the second receiving hole 232 of the connector 200, the plurality of contacts 240 are each independently pivoted in the direction of the thickness of the contact portion 1120*a* to thereby accommodate the torsion of the contact portion 1120*a* of the contact 1120.

Since the screw 72 can be relatively moved within the elongated hole 237*a* of each flange 237 of the housing 230, when the contacts 240 are pivoted in the direction of the thickness of the contact portion 1220*a* or 1120*a*, the housing 230 is also pivoted in the direction of the thickness of the contact portion 1220*a* or 1120*a* along with the movement of the contacts 240 (see FIG. 5). However, since the moving range of the screw 72 is limited by the elongated hole 237*a*, so that the excessive inclination of the housing 230 is limited, which prevents occurrence of a problem that the contact 1120 cannot be inserted into the housing 230.

According to the present embodiment, even when the contact 1120 is displaced or in torsion with respect to the contact 1220 (connector 200), the contact forces generated between the contact portions 1220*a* and 1120*a* of the contacts 1220 and 1210, and the contact portions 241, 242, 243, and 244 of the contacts 240 are hardly changed. Further, the amount of deformation of the contacts 240 is not increased, and hence it is possible to prevent the contacts 240 from being plastically deformed, which makes it possible to maintain the contact stability.

Since the housing 230 of the connector 200 is movably mounted to the panel 71 with the screws 72 inserted through the elongated holes 237*a* of the flanges 237, it is possible to prevent occurrence of a problem that the connector 200 is too inclined for the contact 1120 to be inserted therein.

Further, in the connector 200, since the width of the second receiving hole 232 in the contact-arranging direction A is larger than the width of the contact 1120, and the contact portions 243 and 244 sandwich the portion of the contact portion 1120*a* of the contact 1120 rearward of the front end thereof, even when the contact 1120 is displaced in the contact-arranging direction A or the inserting direction I' (see FIG. 4), it is possible to connect the connector 200 to the contact 1120.

Further, even when the displacement between the contacts 1220 and 1120 in the height direction H with respect to the connector 200 is large, it is possible to positively introduce the contacts 1220 and 1120 into the housing 230 by the guiding surfaces 231*a* and 232*a* of the housing 230.

Next, a description will be given of a connector 300 according to a second embodiment of the present invention with reference to FIGS. 6 to 9.

Differently from the first embodiment in which the connector 200 includes the housing 230, the connector 300 according to the second embodiment does not include a housing.

Figure 6:
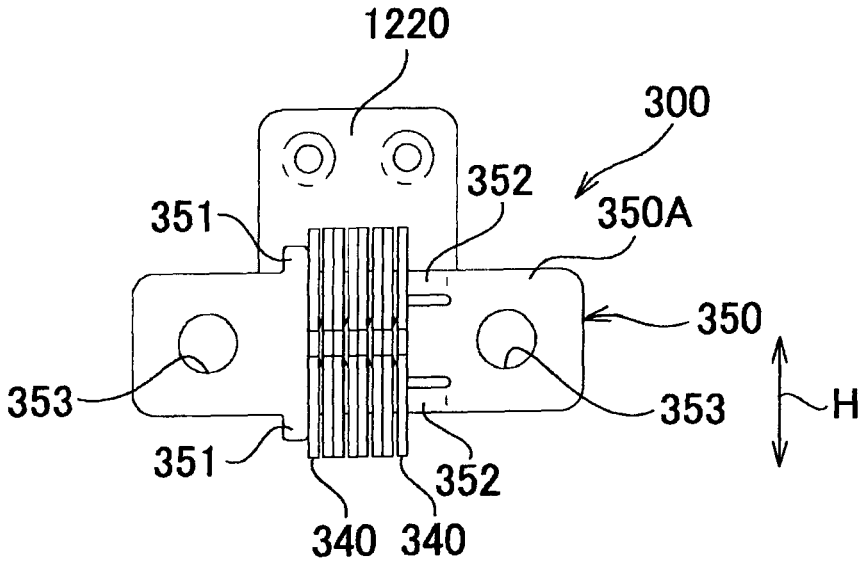
FIG. 6 is a front view of a connector according to a second embodiment of the present invention.
Figure 7:
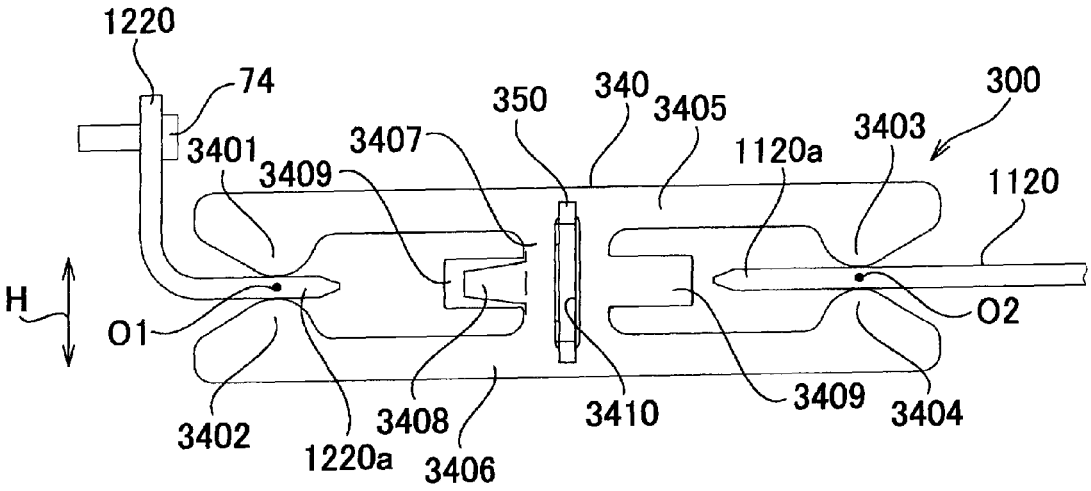
FIG. 7 is a side view of the connector shown in FIG. 6.
Figure 8:
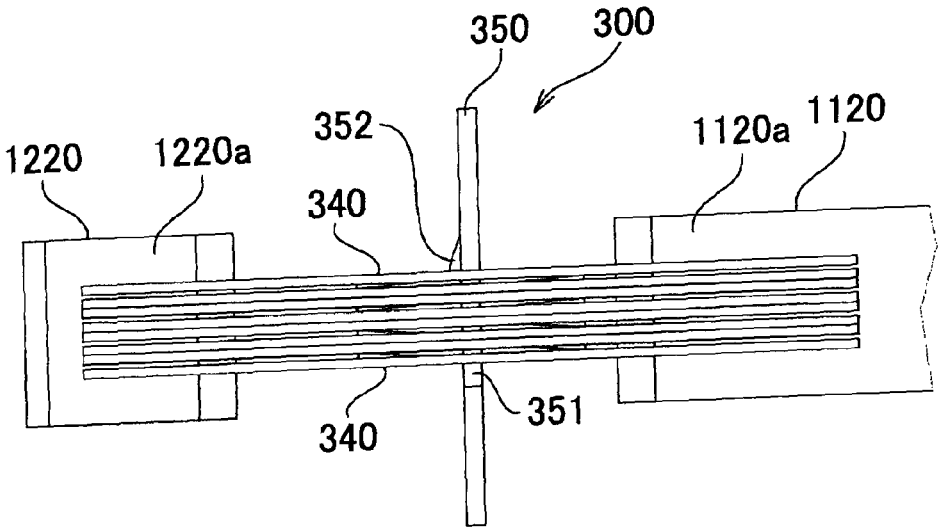
FIG. 8 is a plan view of the connector shown in FIG. 6.
Figure 9:
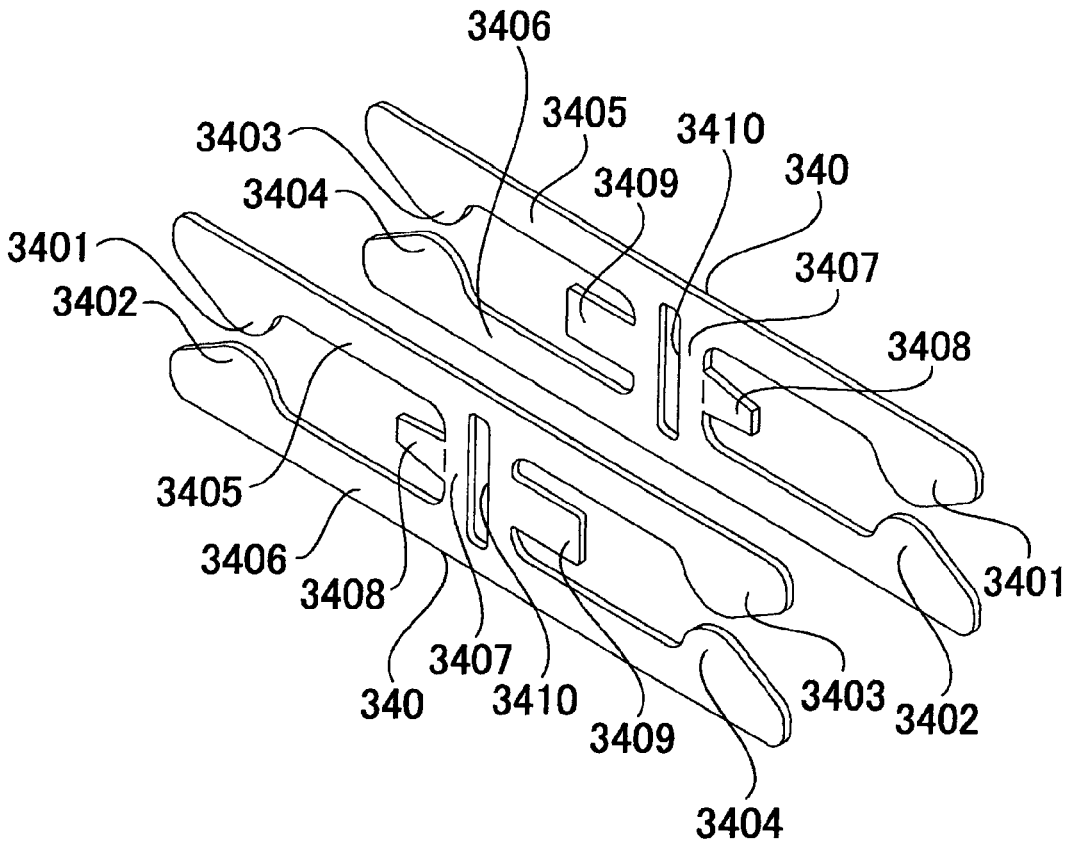
FIG. 9 is a perspective view of contacts of the connector shown in FIG. 6.
Figure 10:
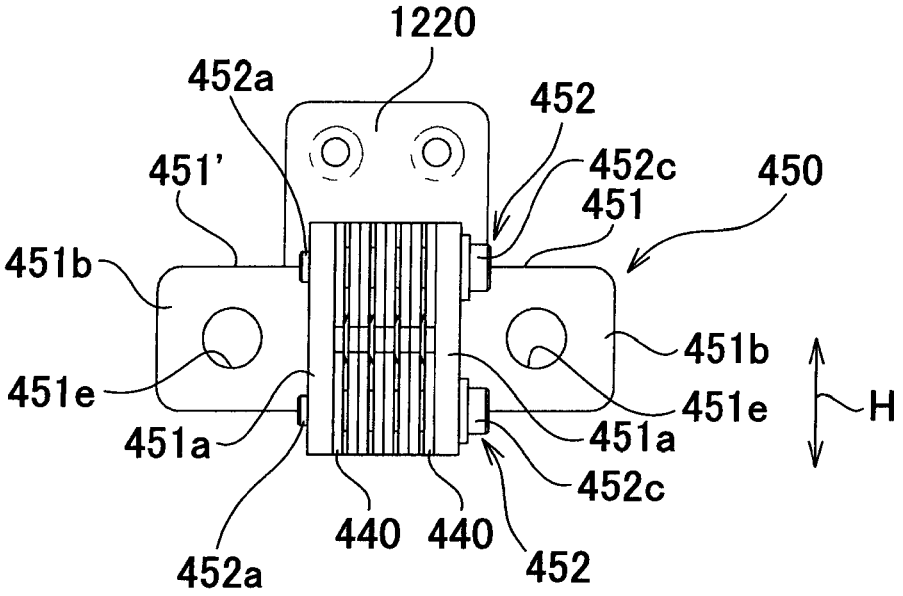
FIG. 10 is a front view of a connector according to a third embodiment of the present invention.
Figure 11:
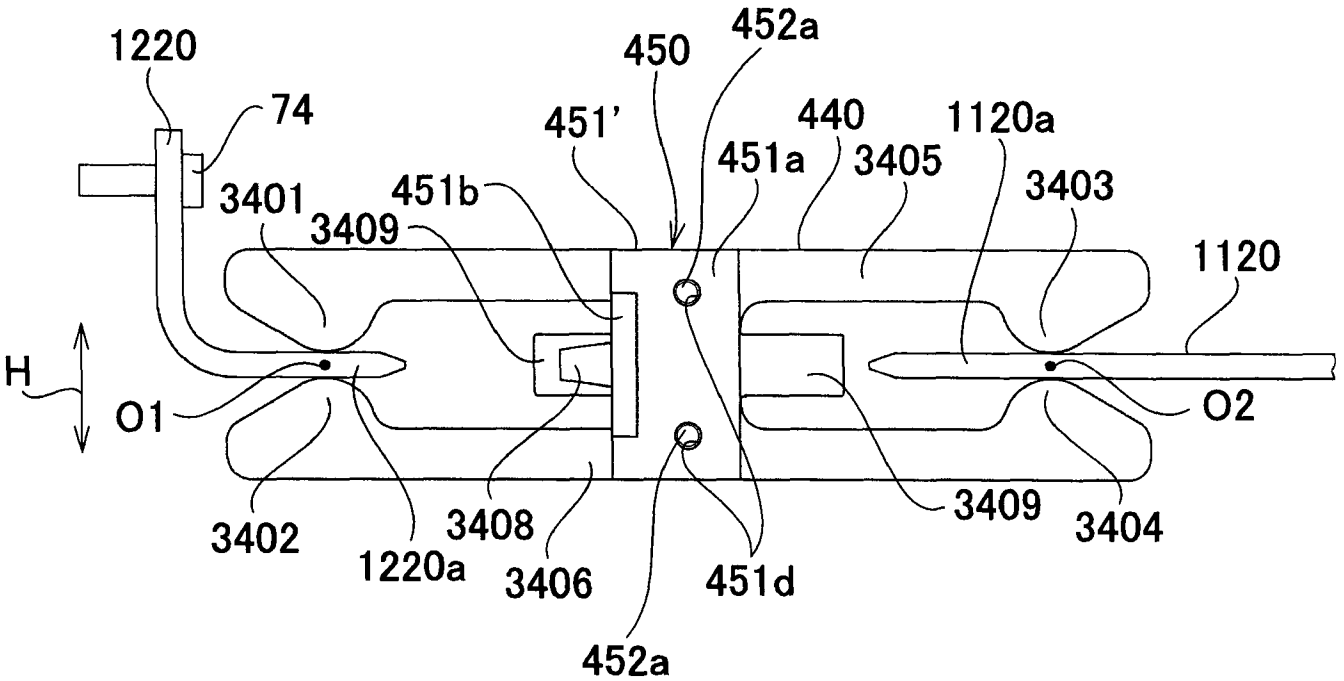
FIG. 11 is a side view of the connector shown in FIG. 10.
Figure 12:
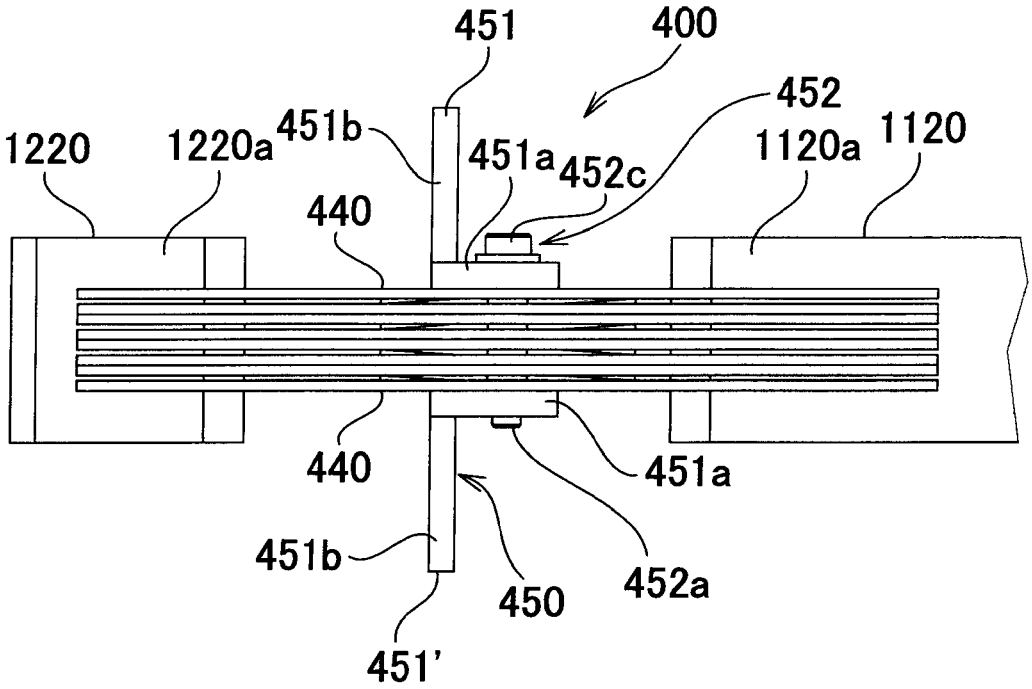
FIG. 12 is a plan view of the connector shown in FIG. 10.
Figure 13:
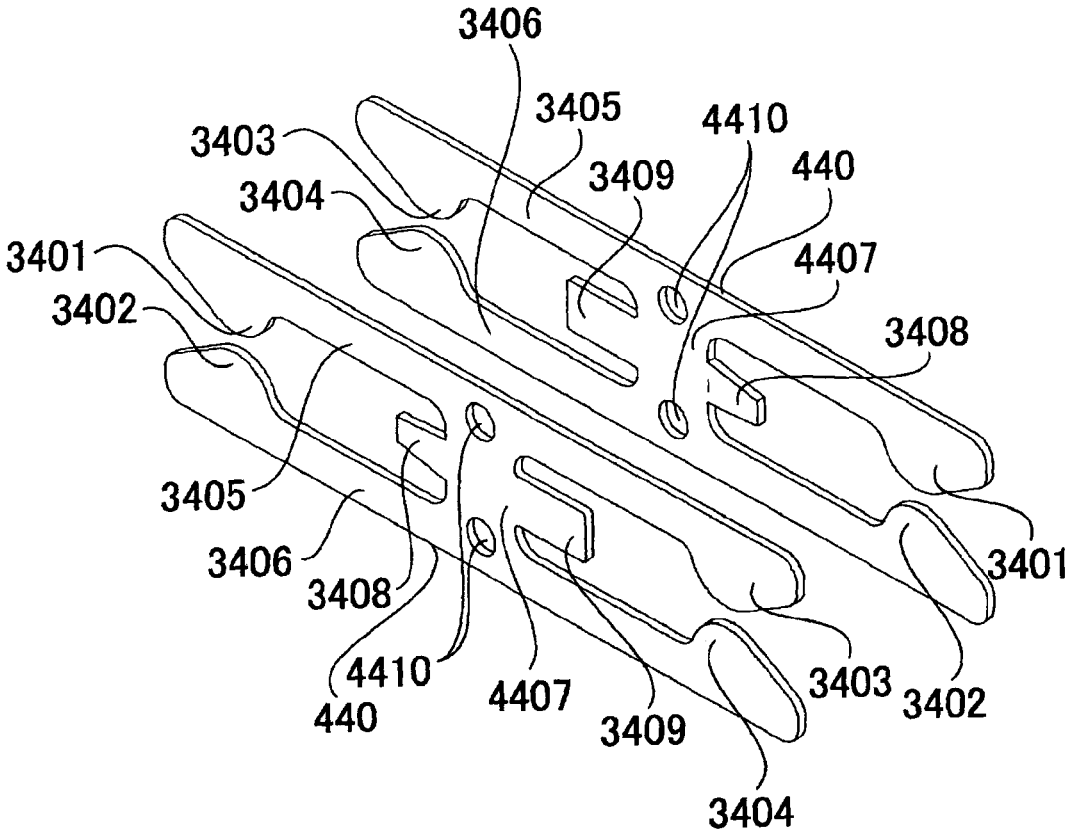
FIG. 13 is a perspective view of contacts of the connector shown in FIG. 10.

As shown in FIGS. 6, 7, and 8, the connector 300 comprises a plurality of contacts (plate-shaped contact) 340 and a uniting member (holding member) 350. The connector 300 is, similarly to the connector 200, used for electrically connecting the contact (first object to be connected) 1220 and the contact (second object to be connected) 1120.

The contacts 340 each include four contact portions 3401, 3402, 3403, and 3404, two holding portions 3405 and 3406, one linking portion 3407, one spring contact portion 3408, and one fixed contact portion 3409. Each contact 340 has a shape which is parallel to the direction of height of the connector 300 and is line-symmetric with respect to a virtual line passing through an elongated hole (insertion hole) 3410, referred to hereinafter, in a longitudinal direction thereof except the spring contact portion 3408 and the fixed contact portion 3409. The plurality of contacts 340 each have the same shape, and are each formed by blanking and bending a metal plate.

The contact portion 3401 and the contact portion 3402 are opposed to each other in the direction H of the height of the connector 300. The contact portions 3401 and 3402 sandwich the contact portion 1220*a* of the contact 1220. Contact points of the contact portions 3401 and 3402 are each formed into a substantially arcuate shape, and are brought into contact with the contact portion 1220*a*. The contact portions 3401 and 3402 sandwich the contact portion 1220*a* of the contact 1220, whereby the contacts 340 are each pivoted about the substantially intermediate point 01 between the contact portions 3401 and 3402 in the direction of thickness of the contact portion 1220*a* of the contact 1220.

The contact portion 3403 and the contact portion 3404 are opposed to each other in the direction H of height of the connector 300. The contact portions 3403 and 3404 sandwich a portion of the contact portion 1120*a* of the contact 1120 rearward of the front end thereof. Contact points of the contact portions 3403 and 3404 are formed into a substantially arcuate shape in cross-section, and are brought into contact with the contact portion 1120*a*. The contact portions 3403 and 3404 sandwich the contact portion 1120*a* of the contact 1120, whereby the contacts 340 are each pivoted about the substantially intermediate point 02 between the contact portions 3403 and 3404 in the direction of thickness of the contact portion 1120*a* of the contact 1120.

One end of the holding portion 3405 is continuous with the contact portion 3401, and the other end is continuous with the contact portion 3403. One end of the holding portion 3406 is continuous with the contact portion 3402, and the other end is continuous with the contact portion 3404.

The linking portion 3407 links the holding portion 3405 and the holding portion 3406.

The spring contact portion 3408 is continuous with the linking portion 3407, and extends rearward. (left side of the connector 300 as viewed in FIG. 7) The spring contact portion 3408 is bent in a direction of thickness of each contact 340.

The fixed contact portion 3409 is continuous with the linking portion 3407, and extends forward. (right side of the connector 300 as viewed in FIG. 7)

The linking portion 3407 is formed with the elongated hole 3410. The elongated hole 3410 is elongated in the direction H of the height of the connector 300, and has one end reaching the holding portion 3405 and the other end reaching the holding portion 3406. The elongated hole 3410 has a width in the longitudinal direction of each contact 340, which is larger than the thickness of the uniting member 350. The elongated hole 3410 has a length in the direction H of the height of the connector 300, which is smaller than the length of a portion of the uniting member 350, formed with stoppers (first stoppers) 351, referred to hereinafter, and is larger than a portion of the uniting member 350 without the stoppers 351.

The uniting member 350 has a substantially rectangular shape, and is formed by blanking and bending a metal plate. The uniting member 350 includes one main body 350A, two stoppers 351, and two swaging portions (second stoppers) 352. The main body 350A is plate-shaped and is inserted through the elongated holes 3410 formed in the plurality of contacts 340. The stoppers 351 are brought into abutment with one of the contacts 340 in the direction of the thickness of each contact 340, which is located at one end of the plurality of contacts 340 arranged in the direction of the thickness of each contact 340. The swaging portions 352 are brought into abutment with one of the contacts 340 in the direction of the thickness of each contact 340, which is located at the other end of the plurality of contacts 340 arranged in the direction of the thickness of each contact 340. One of the stoppers 351 and one of the swaging portions 352 are arranged on an upper end portion of a central portion of the main body 350A with a predetermined space therebetween. The other of the stoppers 351 and the other of the swaging portions 352 are arranged on a lower end portion of the central portion of the main body 350A with a predetermined space therebetween. The stoppers 351 are arranged in line in the direction H of the height of the connector 300. The swaging portions 352 are arranged in line in the direction H of the height of the connector 300. The space between each stopper 351 and each swaging portion 352 is set to be larger than the dimension of the thickness of the group of the contacts 340 in a state in which the plurality of contacts 340 are stacked on each other without spacing in the direction of the thickness thereof.

The main body 350A has opposite longitudinal ends each formed with a fitting hole (screw insertion hole) 353. Screws (not shown) which are similar to the screws 72 used in the first embodiment are inserted through the fitting holes 353. Each fitting hole 353 has an inner diameter which is larger than the outer diameter of a body portion of each screw and smaller than the outer diameter of a head portion of each screw. By employing the above arrangement, the plurality of stacked contacts 340 each can be independently pivoted in the direction of the thickness of the contact portions 1220*a* and 1120*a* of the first and second objects to be connected 1220 and 1120.

To unite the contacts 340, first, the plurality of contacts 340 are stacked on each other in the direction of the thickness of each contact 340. In doing this, the contacts 340 are stacked while alternately changing the direction of each contact 340 such that the spring contact portion 3408 of one of each two adjacent ones of the contacts 340 and the fixed contact portion 3409 of the other of the two adjacent ones of the contacts 340 are overlaid one on the other.

Next, the uniting member 350 is inserted through the elongated holes 3410 of the stacked plurality of contacts 340. In doing this, the uniting member 350 is inserted through the elongated holes 3410 from an end of the uniting member 350 which is closer to the swaging portions 352 than to the stoppers 351, and is inserted until the stoppers 351 are brought into abutment with the stacked plurality of contacts 340.

Finally, the swaging portions 352 of the uniting member 350 are swaged such that the front end of each swaging portion is positioned on a rim of the elongated hole 3410. This prevents the uniting member 350 from being pulled out from the elongated hole 3410, whereby the plurality of contacts 340 are united into one. At this time, the spring contact portion 3408 of one of each adjacent ones of the contacts 340 and the fixed contact portion 3409 of the other of the adjacent ones of the contacts 340 are bought into contact with each other, and hence the stacked plurality of contacts 340 are electrically integrated.

Similarly to the first embodiment, the contacts 340 are mounted to a panel (not shown) with screws (not shown) inserted through the fitting holes 353 of the uniting member 350 in a manner capable of pivoting in the direction of the thickness of the contact portions 1220*a* and 1120*a* only through a predetermined angle. Assuming that the contacts 340 and the contact portion 1220*a* of the contact 1220 are displaced in the direction H of the height of the connector 300, when the contact portion 1220*a* of the contact 1220 fixed to the bus bar 73 (see FIG. 1) with the screws 72 is inserted into one end of the stacked contacts 340, similarly to the first embodiment, the contacts 340 are pivoted in the direction of the thickness of the contact portion 1220*a*, whereby the displacement from the contact portion 1220*a* is accommodated, and the insertion force of the contact portion 1220*a* applied to the contacts 340 is hardly increased.

Assuming that the contacts 340 and the contact portion 1120*a* of the contact 1120 are displaced in the direction H of the height of the connector 300, when the contact portion 1120*a* of the contact 1120 is inserted into the other end of the stacked contacts 340, similarly to the first embodiment, the contacts 340 are pivoted in the direction of the thickness of the contact portion 1120*a*, whereby the displacement from the contact portion 1120*a* is accommodated, and the insertion force of the contact portion 1120*a* applied to the contacts 340 is hardly increased.

In the second embodiment, since the contacts 340 are stacked while alternately changing the direction thereof, the contact portions 3401 and 3402 of each contact 340, which are brought into contact with the contact portion 1220*a* of the contact 1220, form the first contact portion, and the contact portions 3403 and 3404 of each contact 340, which are brought into contact with the contact portion 1120*a* of the contact 1120, form the second contact portion.

According to the second embodiment, it is possible to obtain the same advantageous effects as provided by the first embodiment, and since the spring contact portion 3408 of one of each adjacent ones of the contacts 340 is brought into contact with the fixed contact portion 3409 of the other of the adjacent ones of the contacts 340, it is possible to prevent a large electric current from flowing through part of the contacts 340, causing generation of heat from the part.

Further, since the connector does not have a housing, it is easy to reduce the connector in size and costs.

Next, a description will be given of a connector 400 according to a third embodiment of the present invention with reference to FIGS. 10 to 13.

The third embodiment has the same basic structure as the second embodiment. Component elements identical to those of the second embodiment are denoted by identical reference numerals, and description thereof is omitted, while only main component elements different from those of the second embodiment will be described hereinafter.

Although the uniting member 350 of the second embodiment is formed by one member, a uniting member (holding member) 450 is formed by two fixing portions 451 and 451' (hereinafter referred to as "the L-shaped fixing portions") and two screws 452.

The L-shaped fixing portion 451 includes a sandwiching portion 451*a* and a fitting portion 451*b*. The sandwiching portion 451*a* is substantially plate-shaped. The sandwiching portion 451*a* is formed with two screw insertion holes (not shown). The screws 452 are inserted through the screw insertion holes. The screw 452 has a screw thread portion 452*a*, a body portion (not shown), and a head portion 452*c*. The screw thread portion 452*a* is screwed into an associated one of screw holes 451*d* of the L-shaped fixing portion 451', referred to hereinafter. The body portion is continuous with the screw thread portion 452*a*. The body portion has an outer diameter larger than the outer diameter of the screw thread portion 452*a*. The outer diameter of the body portion is smaller than the inner diameter of each insertion hole 4410 of each contact 440. The body portion has a length larger than the thickness of the group of the contacts 440 in a state in which the plurality of contacts 440 are stacked on each other without spacing in a direction of the thickness of each contact 440. The head portion 452*c* is continuous with the body portion. The head portion 452*c* has an outer diameter larger than that of the body portion. Further, the outer diameter of the head portion 452*c* is larger than the outer diameter of each insertion hole 4410. The fitting portion 451*b* having a substantially plate-like shape is continuous with the sandwiching portion 451*a*, and is at right angles to the sandwiching portion 451*a*. The fitting portion 451*b* is formed with a fitting hole 451*e*. The same screw as the screw 72 used in the first embodiment is inserted through the fitting hole 451*e*. The fitting hole 451*e* has an inner diameter larger than the outer diameter of the body portion of the screw, and smaller than the outer diameter of the head portion of the screw.

The L-shaped fixing portion 451' has substantially the same construction as the L-shaped fixing portion 451, and includes the sandwiching portion 451*a* and the fitting portion 451*b*. The L-shaped fixing portion 451 is different from the L-shaped fixing portion 451' only in that the sandwiching portion 451*a* of the L-shaped fixing portion 451 is formed with the screw insertion holes (not shown), whereas the sandwiching portion 451*a* of the L-shaped fixing portion 451' is formed with the screw holes 451*d* (see FIG. 11). The screw thread portions 452*a* of the screws 452 inserted through the screw insertion holes of the sandwiching portion 451*a* of the L-shaped fixing portion 451 are screwed into the screw holes 451*d*, respectively.

A linking portion 4407 of each contact 440 of the third embodiment is formed with two insertion holes 4410 in place of the elongated hole 3410 of each contact 340 of the second embodiment. The screws 452 of the uniting member 450 are inserted through the insertion holes 4410. Each insertion hole 4410 has an inner diameter larger than the outer diameter of the body portion of the screw 452, and smaller than the outer diameter of the head portion 452*c* of the screw 452.

To unite the contacts 440, similarly to the operation for uniting the contacts 340 in the second embodiment, first, the plurality of contacts 440 are stacked one on the other in a direction of a thickness thereof.

Next, the screws 452 are inserted through the screw insertion holes of the sandwiching portion 451*a* of the L-shaped fixing portion 451 and the insertion holes 4410 of each contact 440.

Finally, the screw thread portions 452*a* of the screws 452 are screwed into the screw holes 451*d* of the L-shaped fixing portion 451'.

By the above operation, the stacked plurality of contacts 440 are sandwiched by the holding portions 451*a* of the L-shaped fixing portions 451 and 451', so that the contacts 440 are mechanically and electrically integrated. The length of the body portion of the screw 452 is larger than the thickness of the contacts 440 in the state in which the plurality of contacts 440 are stacked one on the other without spacing in the direction of the thickness thereof, and what is more, the inner diameter of each insertion hole 4410 is larger than the outer diameter of the body portion of the screw 452. Therefore, the stacked plurality of contacts 440 each can be independently pivoted in the direction of the thickness of the contact portions 1220*a* and 1120*a*.

According to the third embodiment, it is possible to obtain the same advantageous effects as provided by the second embodiment. It should be noted that although the fixing portions 451 and 451' of the present embodiment are each formed into an L-shape by the sandwiching portion 451*a* and the fitting portion 451*b*, the shape of the fixing portions 451 and 451' is not limited to the L-shape. For example, the fitting portion 451*b* need not be provided, or the fitting portion 451*b* may be formed to be flush with the sandwiching portion 451*a*.

Figure 14:
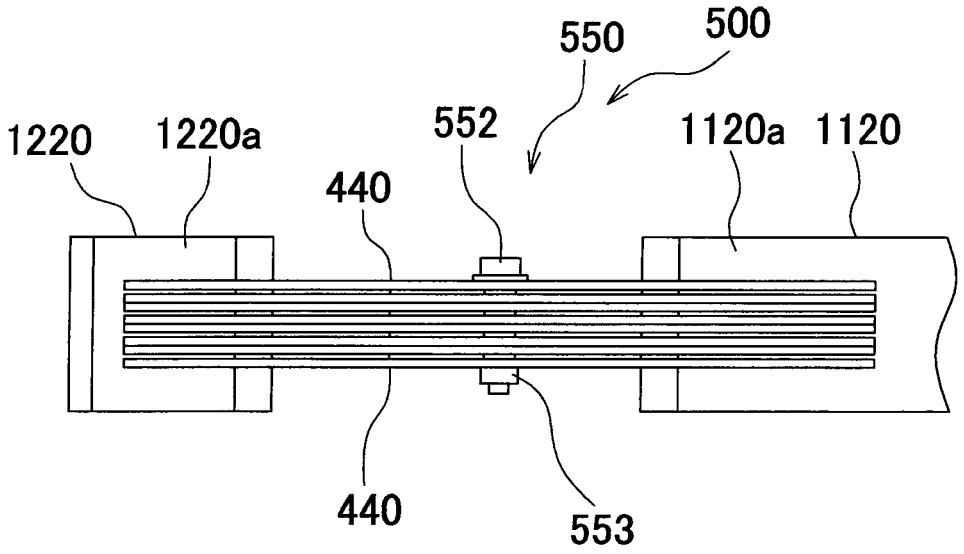
FIG. 14 is a plan view of a connector according to a fourth embodiment of the present invention.

Next, a description will be given of a connector 500 according to a fourth embodiment of the present invention with reference to FIG. 14.

The fourth embodiment differs from the third embodiment only in the arrangement of the holding member, and is identical to the third embodiment in the structure except that. Component elements identical to those of the third embodiment are denoted by identical reference numerals, and description thereof is omitted, while only main component elements different from those of the third embodiment will be described hereinafter.

Although the uniting member (holding member) 450 of the third embodiment is formed by the two fixing portions 451 and 451', and the two screws 452, a uniting member (holding member) 550 of the fourth embodiment is formed by two bolts 552 and two nuts 553 screwed to the bolts 552. In FIG. 14, one of the bolts 552 and one of the nuts 553 are illustrated.

Each bolt 552 has the same shape as the screw 452 used in the third embodiment, and the dimensional relationship between the bolt 552 and the insertion hole 4410 of each contact 440 is also substantially the same as that between the screw 452 and the insertion hole 4410 of each contact 440 in the third embodiment.

The plurality of contacts 440 are united only by the two pairs of the bolts 552 and the nuts 553. Differently from the connector 400 of the third embodiment, due to the structure of the connector 500 of the fourth embodiment, the connector 500 cannot be mounted to the casing-shaped panel 71.

According to the fourth embodiment, it is possible to obtain the same advantageous effects as provided by the second embodiment, and it is possible to realize the simpler arrangement than that of the uniting member 450 of the third embodiment, which makes it possible to further reduce the production costs.

It should be noted that although in the above-described first embodiment, the plurality of contacts 240 are each slidably accommodated in the contact-accommodating hole 230A, the plurality of contacts 240 may be fixed to the housing 230.

Further, although in the above-described second, third, and fourth embodiments, the plurality of contacts 340 and 440 are each capable of independently pivoting, the plurality of contacts 340 and 440 may be connected so as to prevent the plurality of contacts 340 and 440 from independently pivoting.

Although in the above-described first to fourth embodiments, the contact points of the contact portions 241, 242, 243, 244, 3401, 3402, 3403, and 3404 of the contacts 240, 340, and 440 are each formed into an arcuate shape, the contact points are not necessarily formed into an arc shape, but for example, the contact points may be formed into a substantially triangular shape. If the contact points are formed into a substantially triangular shape, it is possible to further prevent the operation force of the connector from being increased.

According to the present invention, by changing the number of stacked contacts, it is possible to provide connectors adapted to various current capacities. That is, when the allowable current is small, the number of stacked contacts is reduced to two or three, whereas when the allowable current is large, the number of stacked contacts is increased to three or more. This makes it possible to provide connectors adapted to various current capacities.

Further, to make the connector adapted to various current capacities by stacking contacts of the same type can reduce the costs, compared with a case in which the connector is adapted to various current capacities by stacking contacts of different types.

It is further understood by those skilled in the art that the foregoing are the preferred embodiments of the present invention, and that various changes and modification may be made thereto without departing from the spirit and scope thereof.

What is claimed is:

1. A connector that electrically connects a first object to be connected and a second object to be connected to each other, the connector comprising:

a plurality of plate-shaped contacts each including a first contact portion that is configured to sandwich a first plate-shaped contact portion of the first object to be connected in a manner capable of relatively pivoting in a direction of thickness of the first plate-shaped contact portion, and a second contact portion that is configured to sandwich a second plate-shaped contact portion of the second object to be connected in a manner capable of relatively pivoting in a direction of thickness of the second plate-shaped contact portion; and a holding member that holds said plurality of plate-shaped contacts in a state arranged in a direction of thickness thereof;

wherein each of said plurality of plate-shaped contacts is supported by said holding member in a manner capable of pivoting in the direction of thickness of each of the first and second plate-shaped contact portions of the first and second objects to be connected;

wherein an entirety of each of said plurality of plate-shaped contacts is capable of pivoting about one of the first contact portions or one of the second contact portions with respect to the holding member;

wherein said holding member is a housing that has a contact-accommodating hole for accommodating said plurality of plate-shaped contacts;

wherein said plurality of plate-shaped contacts are each accommodated in the contact-accommodating hole in a state in which said plurality of plate-shaped contacts are slidably held; and wherein said plate-shaped contacts each include a linking portion and a lance, and said housing includes stoppers each of which is brought into abutment with one of said linking portions, and engaging portions each of which latches one of the lances.

2. The connector as claimed in claim 1, wherein said plurality of plate-shaped contacts have the same shape.

3. The connector as claimed in claim 1, wherein said holding member has screw insertion holes for movably mounting said holding member to a casing to which the first object to be connected is fixed.

4. The connector as claimed in claim 3, wherein said plurality of plate-shaped contacts have the same shape.

5. A connector that electrically connects a first object to be connected and a second object to be connected to each other, the connector comprising:

a plurality of plate-shaped contacts each including a first contact portion that is configured to sandwich a first plate-shaped contact portion of the first object to be connected in a manner capable of relatively pivoting in a direction of thickness of the first plate-shaped contact portion, and a second contact portion that is configured to sandwich a second plate-shaped contact portion of the second object to be connected in a manner capable of relatively pivoting in a direction of thickness of the second plate-shaped contact portion; and a holding member that holds said plurality of plate-shaped contacts in a state arranged in a direction of thickness thereof;

wherein each of said plurality of plate-shaped contacts is supported by said holding member in a manner capable of pivoting in the direction of thickness of each of the first and second plate-shaped contact portions of the first and second objects to be connected;

wherein said plate-shaped contacts each have an intermediate portion formed with an insertion hole; and wherein said holding member includes a plate-shaped main body which is inserted through the insertion holes of said plurality of plate-shaped contacts arranged in the direction of the thickness thereof, first stoppers which are provided on the main body, and are brought into contact with one of the plate-shaped contacts in the thickness direction, which is located at one end of the plurality of plate-shaped contacts arranged in the direction of the thickness thereof, and second stoppers which are provided on the main body, and are brought into contact with one of the plate-shaped contacts in the thickness direction, which is located at the other end of the plurality of plate-shaped contacts arranged in the direction of the thickness thereof.

6. The connector as claimed in claim 5, wherein said holding member has screw insertion holes for movably mounting said holding member to a casing to which the first object to be connected is fixed.

7. The connector as claimed in claim 5, wherein the plurality of plate-shaped contacts are in contact with each other in the thickness direction.

8. The connector as claimed in claim 7, wherein the plurality of plate-shaped contacts have the same shape.

9. A connector that electrically connects a first object to be connected and a second object to be connected to each other, the connector comprising:

a plurality of plate-shaped contacts each including a first contact portion that is configured to sandwich a first plate-shaped contact portion of the first object to be connected in a manner capable of relatively pivoting in a direction of thickness of the first plate-shaped contact portion, and a second contact portion that is configured to sandwich a second plate-shaped contact portion of the second object to be connected in a manner capable of relatively pivoting in a direction of thickness of the second plate-shaped contact portion; and a holding member that holds said plurality of plate-shaped contacts in a state arranged in a direction of thickness thereof;

wherein each of said plurality of plate-shaped contacts is supported by said holding member in a manner capable of pivoting in the direction of thickness of each of the first and second plate-shaped contact portions of the first and second objects to be connected; and wherein said plate-shaped contacts each have an intermediate portion formed with insertion holes, and wherein said holding member includes a pair of fixing portions that sandwich said plurality of plate-shaped contacts in the direction of thickness thereof, which are arranged in the direction of the thickness thereof, and screws which are inserted through the insertion holes of said plurality of plate-shaped contacts arranged in the direction of the thickness thereof, and connect the pair of fixing portions.

10. The connector as claimed in claim 9, wherein said holding member has screw insertion holes for movably mounting said holding member to a casing to which the first object to be connected is fixed.

11. The connector as claimed in claim 9, wherein the plurality of plate-shaped contacts are in contact with each other in the thickness direction.

12. The connector as claimed in claim 11, wherein the plurality of plate-shaped contacts have the same shape.

13. A connector that electrically connects a first object to be connected and a second object to be connected to each other, the connector comprising:

a plurality of plate-shaped contacts each including a first contact portion that is configured to sandwich a first plate-shaped contact portion of the first object to be connected in a manner capable of relatively pivoting in a direction of thickness of the first plate-shaped contact portion, and a second contact portion that is configured to sandwich a second plate-shaped contact portion of the second object to be connected in a manner capable of relatively pivoting in a direction of thickness of the second plate-shaped contact portion; and a holding member that holds said plurality of plate-shaped contacts in a state arranged in a direction of thickness thereof;

wherein each of said plurality of plate-shaped contacts is supported by said holding member in a manner capable of pivoting in the direction of thickness of each of the first and second plate-shaped contact portions of the first and second objects to be connected; and wherein said plate-shaped contacts each have an intermediate portion formed with insertion holes, wherein said holding member is formed by bolts which are inserted through the insertion holes of said plurality of plate-shaped contacts arranged in the direction of the thickness thereof, and nuts which are screwed onto the bolts.

14. The connector as claimed in claim 13, wherein the plurality of plate-shaped contacts are in contact with each other in the thickness direction.

15. The connector as claimed in claim 14, wherein the plurality of plate-shaped contacts have the same shape.

16. A connector that electrically connects a first object to be connected and a second object to be connected to each other, the connector comprising:

a plurality of plate-shaped contacts each including a first contact portion that is configured to sandwich a first plate-shaped contact portion of the first object to be connected in a manner capable of relatively pivoting in a direction of thickness of the first plate-shaped contact portion, and a second contact portion that is configured to sandwich a second plate-shaped contact portion of the second object to be connected in a manner capable of relatively pivoting in a direction of thickness of the second plate-shaped contact portion; and a holding member that holds said plurality of plate-shaped contacts in a state arranged in a direction of thickness thereof;

wherein said plate-shaped contacts each have an intermediate portion formed with an insertion hole; and wherein said holding member includes a plate-shaped main body which is inserted through the insertion holes of said plurality of plate-shaped contacts arranged in the direction of the thickness thereof, first stoppers which are provided on the main body, and are brought into contact with one of the plate-shaped contacts in the thickness direction, which is located at one end of the plurality of plate-shaped contacts arranged in the direction of the thickness thereof, and second stoppers which are provided on the main body, and are brought into contact with one of the plate-shaped contacts in the thickness direction, which is located at the other end of the plurality of plate-shaped contacts arranged in the direction of the thickness thereof.

17. The connector as claimed in claim 16, wherein said holding member has screw insertion holes for movably mounting said holding member to a casing to which the first object to be connected is fixed.

18. The connector as claimed in claim 16, wherein the plurality of plate-shaped contacts are in contact with each other in the thickness direction.

19. The connector as claimed in claim 18, wherein the plurality of plate-shaped contacts have the same shape.

* * * * *

UNITED STATES PATENT AND TRADEMARK OFFICE

CERTIFICATE OF CORRECTION

PATENT NO. : 8,998,618 B2
APPLICATION NO. : 13/173426
DATED : April 7, 2015
INVENTOR(S) : Osamu Hashiguchi It is certified that error appears in the above-identified patent and that said Letters Patent is hereby corrected as shown below:

In the Specification

Column 6, Line 60, delete “01” and insert --O1--.

Column 7, Line 22, delete “02” and insert --O2--.

Column 8, Line 45, delete “01” and insert --O1--.

Column 8, Line 58, delete “02” and insert --O2--.

Signed and Sealed this
Third Day of November, 2015

Michelle K. Lee

Michelle K. Lee
*Director of the United States Patent and Trademark Office*